United States Patent [19]

Gutridge et al.

[11] 4,319,528

[45] Mar. 16, 1982

[54] RAILWAY PASSENGER CAR INTERIOR PANELING AND FINISH ASSEMBLY

[75] Inventors: Jack E. Gutridge, Dyer; Ernest J. Nagy, Munster, both of Ind.

[73] Assignee: Pullman Incorporated, Chicago, Ill.

[21] Appl. No.: 960,406

[22] Filed: Nov. 13, 1978

[51] Int. Cl.[3] ..... B61D 17/08; B61D 17/18; B61D 49/00

[52] U.S. Cl. ..... 105/397; 52/288; 52/476; 105/329 R; 105/401; 105/423

[58] Field of Search ..... 52/222, 288, 476, 716, 52/824; 105/329 R, 396, 397, 401, 421, 422, 423; 46/40

[56] References Cited

U.S. PATENT DOCUMENTS

| | | | |
|---|---|---|---|
| 2,496,910 | 2/1950 | Fridolph | 52/716 |
| 2,925,050 | 2/1960 | Candlin, Jr. et al. | 105/423 |
| 3,349,530 | 10/1967 | Zigler | 52/288 |
| 3,458,963 | 8/1969 | Klein | 52/288 |
| 3,475,851 | 11/1969 | Christiansen | 46/40 |
| 3,475,871 | 11/1969 | Saunders et al. | 52/288 |
| 3,549,471 | 12/1970 | Denton | 52/288 |
| 3,815,306 | 6/1974 | Tantlinger | 52/288 |

FOREIGN PATENT DOCUMENTS

| | | | |
|---|---|---|---|
| 719496 | 4/1942 | Fed. Rep. of Germany | 105/397 |

*Primary Examiner*—Howard Beltran
*Attorney, Agent, or Firm*—Richard J. Myers

[57] ABSTRACT

The interior wall construction of a passenger railway car is provided with carpeted decorative panels which are fabricated before assembly with the interior wall construction. The attachment of the panels to the wall is provided by extrusions of rigid and resilient shape which permit the panels to be installed by snap-fit interengagement.

6 Claims, 9 Drawing Figures

13
15
17
16
19
29
56
57
58
59
60
61
62
63
64
65
66
67
68
71
76
77

RAILWAY PASSENGER CAR INTERIOR PANELING AND FINISH ASSEMBLY

BACKGROUND OF THE INVENTION

1. Field of the Invention

The present invention relates to railway passenger cars and more particularly to a method of installing and a finished construction of decorative panels within the car.

2. Description of the Prior Art

In the prior art, the finished application of decorative paneling of a railway passenger car interior generally was by the utilization of screws or similar fasteners connected to the structural parts of the interior wall. With the skin or sheathing of the panels once in place, the practice then was to bond carpeting or other decorative materials to the interior panels in a final operation. Extruded brackets and other fixtures would then be secured to the installed carpet and panel construction for the purpose of supporting various pertinences within the car. Extrusions or other molded devices would include seat tracks, lamp holders, arm rests, etc., which then would be fastened to the type of securing brackets utilized. In the present invention, the improved structure utilized a combination of flexible and rigid extruded brackets, with the carpeting or decorative material directly bonded to the sheathing or panel sheet prior to installation. The rigid extrusion includes means to snap fasten the panel assemblies in position within the flexible or rubber-like extrusions. This is an improvement over the aforementioned construction and method described.

SUMMARY OF THE INVENTION

The invention disclosed in the present construction provides for an improved method and structure of securing decorative interior panels to the interior of a transit car. In the present construction, the transit car is provided with longitudinally extending supporting members which form the essential portions of the roof and side structure, or body, of the car. The longitudinally extending supporting members may consist of z-shaped stringers having inner and outer flanges, with outer skin connected to the outer flanges, and with inner sheathing or paneling connected to the inner flanges of the z-shaped stringers. In the present construction, the interior panels comprise a relatively thin sheet adapted to conform to the curvature of the walls of the car, extending from the roof downwardly to the floor section of the car. The panels are preliminarily attached or bonded to interior carpeting or similar decorative material. In order to secure the panel sheets to the interior structure of the car there are provided rubber-like or flexible extrusions which include recesses and openings, with fasteners secured through the openings into the structural supporting members of the car. A second rigid extrusion is then applied to engage and secure the decorative panels in position. The rigid extrusion is provided with a bulbous projection which is placed into the recesses of the flexible extrusion in a snap-fit manner, thus securely connecting the panels and the extrusions to the longitudinal beam structure of the car. The rigid extrusions project inwardly into the car and also include various recesses or openings which adapt them for connection to various equipment or pertinences which normally are provided in the railway passenger car. For example, these may be lamps, mirrors, seat tracks, or light fixtures.

DESCRIPTION OF THE PREFERRED EMBODIMENT

Figures 1, 2, 3, 4:
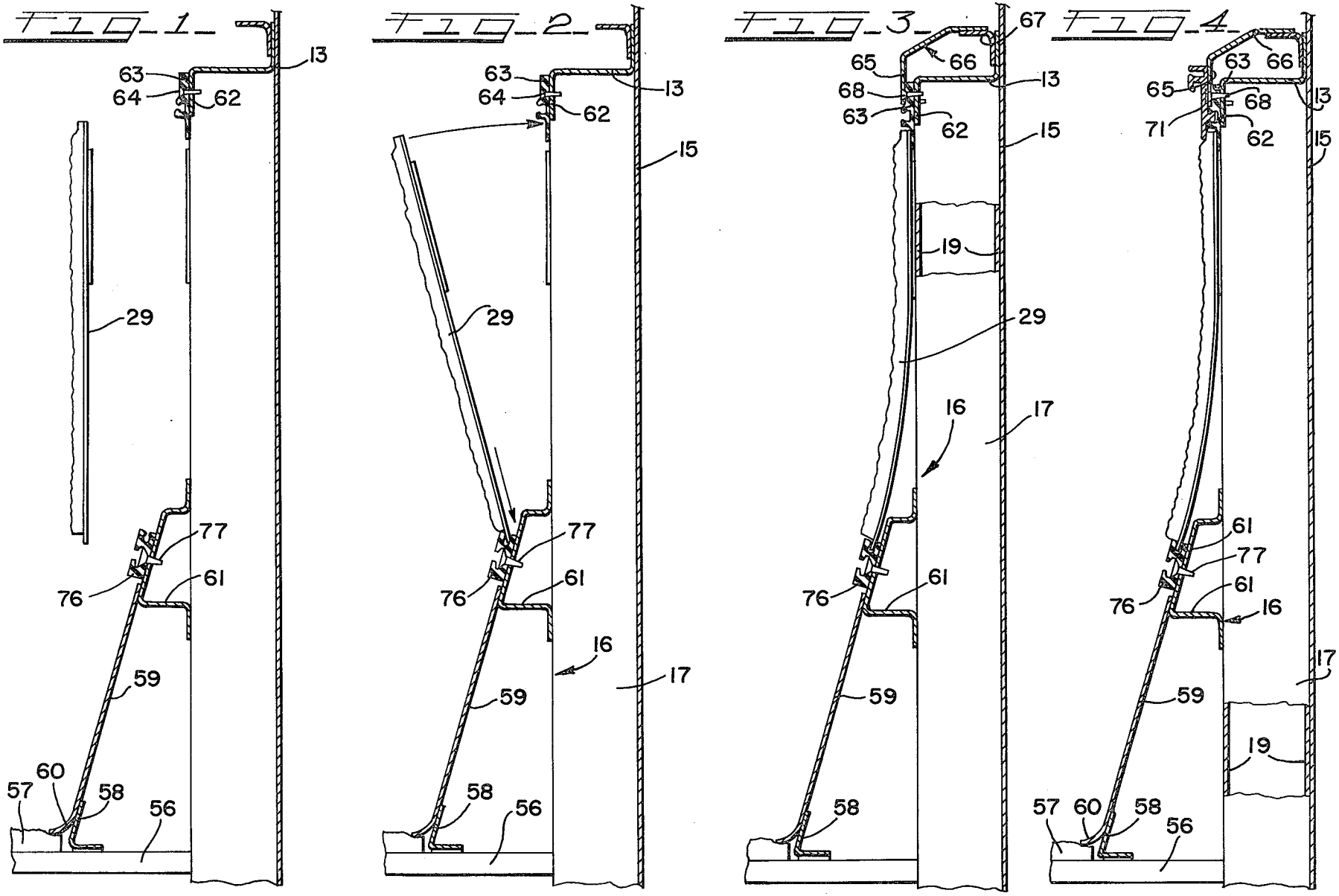
FIG. 1 is a vertical section through a side wall portion of a railway car showing a panel adapted to the installed.
FIG. 2 is a similar view to FIG. 1 showing a lower end of a decorative panel in engagement with the recess of a flexible extrusion mounted on the inner side wall of the railway car.
FIG. 3 is a view similar to FIG. 2 disclosing a panel supported on the side of a railway car with a structural cap in position over an upper flexible extrusion.
FIG. 4 is a view similar to FIG. 3 showing the final application of an upper rigid extrusion to secure the decorative panel in locked position on the side wall of the car.
Figures 5, 6, 7, 8, 9:
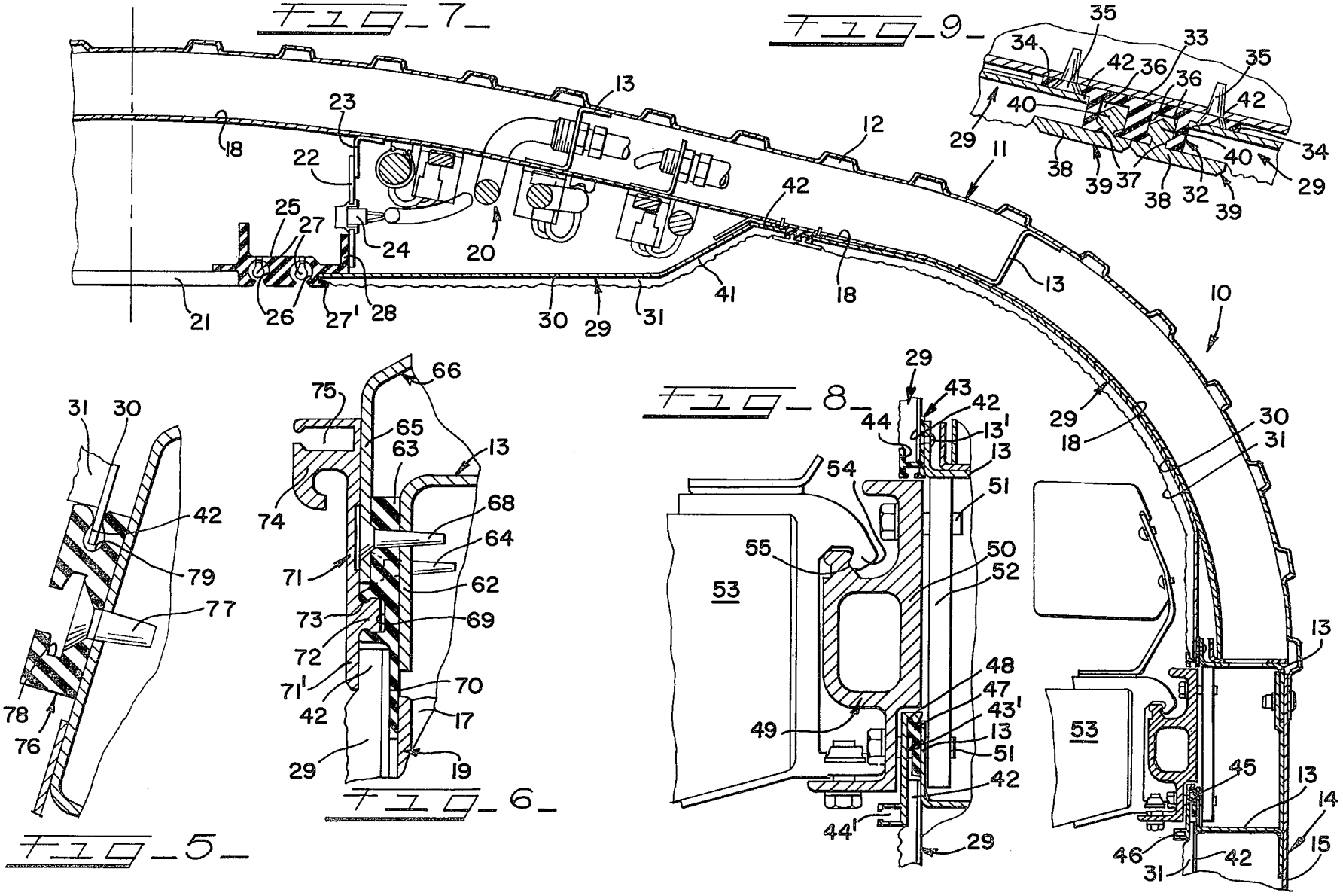
FIG. 5 is an enlarged view in section of a flexible lower extrusion shown in FIGS. 1–4.
FIG. 6 is an enlarged cross-sectional view showing the flexible extrusion which is located at the upper portion of FIG. 4.
FIG. 7 is a cross-sectional view through a roof structure of a railway passenger car showing the installation of decorative paneling in the roof area of the car.
FIG. 8 is an enlarged sectional view of the lower portion of FIG. 7 showing the structural connection between the roof members and side members of a railway car and showing the position and attachment of flexible and rigid extrusions in snap-fit arrangement with an auxiliary bracket for supporting equipment required within the car.
FIG. 9 is a cross-sectional view showing the interconnection of a pair of roof panels with the structural portions of the roof of the car.

Referring particularly to FIG. 7 the upper portion of a railway car body 10 is disclosed in section. A roof structure 11 includes outer corregated sheathing 12 fixedly secured to longitudinally extending support members or stringers 13 positioned in laterally spaced relation. The lower ends of the stringers 13 are connected to vertical body side walls generally designated at 14. As shown in FIGS. 1–4, the outer sheathing 15 is suitably connected to vertical post 17 of generally channel-shaped construction which are longitudinally spaced along the length of the railway car body portion 10. An interior wall structure is generally designated by the reference character 16. The vertical posts have connected thereto and co-extensive with the body a skin or inner wall sheathing designated at 18. As best shown in FIGS. 3 & 4, the vertical post 17 include flanges 19. The sheathing 15 is connected to the other flanges.

Referring now particularly to FIG. 7, the roof structure 11 may include electrical conduit and electrical equipment, etc., designated generally at 20. This equipment is, of course, recessed within the roof structure so as to be hidden from view when the interior of the car is finished. A central light panel 21 is suitably supported by a vertical support 22, in turn connected to a downwardly extending angle bracket 23. The vertical support 22 supports a plug 24 which in turn may be connected to the electrical equipment generally designated at 20. A flexible extrusion or support member 25 is provided with grooves 26 which open downwardly outwardly and which include lighting elements 27. The extrusion 25 also includes an upwardly extending flange 28 which is secured to the vertical support bracket 22. The interior of the car is finished by the utilization of decorative panel members 29 consisting of relatively thin sheet plate 30 which is formed to conform to the contour of the car, i.e., the roof structure and the side wall structure constituting the interior finish. The thin plate member 30 has bonded thereto decorative carpeting 31 which may also consist of other types of decorative material. As best shown in FIG. 7, the panel 29 is supported at the left end within the recess 27' provided in the extrusion 25. The other end of the panel 29 disclosed in FIG. 7 is supported, as best shown in FIG. 9, by means of a flexible extrusion generally designated at 32. The extrusion 32 comprises a base 33 having outwardly projecting extensions 34 suitably provided with openings through which self-threading screws 35 extend and are threaded into the inner skin or wall sheathing 18 provided in the roof structure. Rigid extrusions 43 comprise base plates 38 to which the bulbous projections 40 are connected. The flexible extrusion 32 includes sockets or recesses 36 within which are secured bulbous projections 40, having the same captured therein by means of inwardly projecting mechanism 37 located at the outer edges of the apertures or recesses 36. As best shown in FIGS. 7 & 9, the panel 29 is provided with a diagonally extending plate portion 41 and a peripheral edge or flange 42. The carpeting and the flange 42 are retained by means of the extrusions 39 and 32. Another of the panels 29 of arcuate shape extends downwardly and is suitably connected to a flexible extrusion 43 provided with a recess 44 as best shown in FIG. 8. The extrusion 43 is suitably connected to a portion of one of the stringers 13. A rivet type fastener 13' suitably connects the extrusion 43 to the latter mentioned stringer. It is noted that the lower end of the panel 29 is retained in firm, fixed relation with respect to the recess 44, in effect this providing for a snap action assembly. Referring now particularly to FIG. 8, the upper end of a decorative panel 29 is supported on another of the stringers 13. A flexible extrusion 47 is supported on the stringer 13 and has connected thereto a rigid extrusion 43'. The extrusion 43' has a lower portion engaging the peripheral edge 42 of one of the panels 29 and for clamping the same into engagement with the stringer 13. The rigid extrusion 43' also is provided with a recess 44' which may be utilized to either support other interior equipment or to act as a guide. The upper end of the rigid extrusion 43' is provided with a recess 48 that engages the upper portion of a flexible extrusion 47 and is thereupon supported. An extruded bracket structure 49 is generally designated. The bracket structure 49 includes a rigid extrusion 50 which is securely connected by means of bolt and nut fasteners 51 to a vertical plate 52 suitably supported on the stringer structure. The bolt and nut fasteners 51 also extend through the rigid extrusion 43' and flexible extrusion 47 supporting the same on a said stringer and also connecting with the vertical plate 52. A light assembly 53 includes a hook bracket portion 54 which is engaged within a socket 55 on the rigid extrusion 50 for supporting the assembly 53 thereon.

Referring now particularly to FIGS. 1–4 a railway car body includes a floor 56 having suitable carpeting 57 thereon. An angle 58 connected to the floor 56 is in turn connected to a metal panel 59 which extends upwardly and outwardly. The lower end of panel 59 is provided with a curved portion 60 which is seated upon an end of the carpeting 57. The metal panel 59 extends upwardly and is suitably connected to a channel-shaped longitudinally extending panel support 61 which is in turn connected to the inner flanges 19 of one or more of the vertical posts 17. Another panel support 62 is the downwardly extending flange of one of the longitudinally extending stringers 13 as best shown in FIGS. 1–4. The panel support 62 includes a flexible extrusion 63 which is connected to the panel support 62 by means of a thread-cutting screw 64. A flange 65 of a cap 66 is positioned atop of the upper end of the flexible extrusion 63. The diagonally extending cap 66 is suitably connected to an angle 67 supported on the longitudinally extending stringer 13. Another thread-cutting screw 68 secures the flange 65 through the extrusion 63 to the panel support 62 of the stringer 13. As shown in FIG. 6, the extrusion 63 also includes a downwardly extending flexible flange 70 which engages the peripheral edge 42 of one of the panels 29. The rigid extrusion 71, as best shown in FIG. 6, includes an enlarged or bulbous portion 72 which is in locking engagement with the recess 69 of the flexible extrusion 63. Snap-fit relation is provided by means of the restricted neck 73 on the extrusion 63 in the area of the recess 69. The rigid extrusion 71 is also provided with a lower extension 71' which clamps the peripheral edge 42 of the panel 29 into engagement with the flange 70. As best shown in FIG. 6, the extrusion 71 is also provided with a head portion 74 containing a horizontally extending recess 75. The recess 75 is provided for the application of auxiliary equipment or pertinences provided in the interior of the railway passenger car. As best shown in FIGS. 1–4 and 5, the lower end of the panel 29 is supported and connected to a flexible extrusion 76 which is connected to the panel support 61 by means of a thread-cutting screw 77. The extrusion 76 also includes a recess 78 which may be utilized as a seat slide or may accommodate and support other pertinences and equipment within the interior of the car. The upper end of the extrusion 76 is provided with a recess 79 within which the peripheral edge 42 of one of the decorative panels 39 is retained as best shown in FIG. 5.

THE OPERATION

The various structures of securing the panels in position with relation to the extrusions is clear from the drawings. During assembly of the panels the carpeting is bonded to each of the panels prior to its installation within the car. The various flexible extrusions are placed in the positions indicated, the same being attached to the structural interior members of the car by self-threading screws after drilling suitable holes. As best shown in FIGS. 1–4, the side panels with the carpeting are positioned with their lower edges in engagement with the flexible extrusion 76 whereupon the same is then placed into the position shown in FIG. 3 against the flange 70. It is then a simple matter to merely attach the cap 66 onto the flexible extrusion 63 in the manner shown in FIG. 3 whereupon the self-threading screws 68 are inserted into the panel support 62 of the stringer thus also effectively supporting the extrusion 63 in position. The assembler then merely assembles the rigid extrusion 71 by forcing the enlarged head portion 72 in the recess 69 provided to effectuate a snap-fit interengagement. Thus the assembly is now complete and the panels are in position. In each instance the rigid extrusions also may be utilized for other purposes such as retention of brackets and supporting of interior equipment.

In the connection of the roof panels FIGS. 7 and 9 disclose the assembled position wherein the ends of the panels are firmly supported in the flexible extrusions, which include the rigid extrusions 38 having their bulbous projections 37 in snap-fit engagement with the flexible extrusion 32.

FIG. 8 discloses the attachment of the arcuate panels 29 at their lower ends which includes the interengagement of the peripheral edges 42 of the panels 29 with the recesses 44 of the flexible extrusion 43. Also, the bracket connections of the bracket structure 49 supports the lower extrusion 43' and flexible extrusion 47.

Thus, a novel construction of the interior of the car including decorative panels has been disclosed and that a unique method of assembling the decorative panels with the interior car construction is afforded.

What is claimed is:

1. In a passenger railway car having a body including a plurality of support members, outer wall construction including outer sheathing connected to outer portions of said support members, and interior wall construction spanned between and connected to inner portions of the support member, the interior wall construction consisting of at least one interior panel including a section of interior sheathing, the improvement being means for connecting each interior panel to the support members comprising the combination of:

first extrusion means being removably secured relative to the interior portions of the support members, said first extrusion means having a recess receiving an edge portion of the interior panel, second extrusion means having a portion being overlapped in part by another edge of the interior panel, and being provided with a recess opening away from the outer wall construction, and third extrusion means being releasably interlocked with said second extrusion means and thereupon also in part overlapping the other edge of the interior panel to hold the same against said underlying second extrusion, said third extrusion means comprising a rigid locking portion adapted to be snap fitted within the recess of the second extrusion means.

2. The invention in accordance with claim 1, wherein each of said first extrusion means is comprised of a resilient material.

3. The invention in accordance with claim 2 wherein each extrusion of said first extrusion means includes projecting wall portions engaging and retaining said interior panel.

4. The invention in accordance with either claim 1 or claim 2 wherein said second extrusion means is comprised of a flexible material.

5. The invention in accordance with claim 1 wherein said first and second extrusion means provide support means for auxiliary equipment within said car.

6. The invention in accordance with claim 1 wherein each said interior panel includes, flexible materials bonded to said interior sheathing.

* * * * *